United States Patent [19]

Wilson

[11] Patent Number: 4,473,969

[45] Date of Patent: Oct. 2, 1984

[54] HOUSING FOR SPRING WOUND TOY

[76] Inventor: Paul A. Wilson, 333 S. Doheny Dr., Los Angeles, Calif. 90048

[21] Appl. No.: 141,958

[22] Filed: Apr. 21, 1980

[51] Int. Cl.[3] ..... A63H 17/00

[52] U.S. Cl. ..... 46/1 R; 224/245; 446/464

[58] Field of Search ..... 46/1 F, 1 R, 1 K, 202, 46/206; 63/1; 224/196, 241, 245

[56] References Cited

U.S. PATENT DOCUMENTS

| | | | |
|---|---|---|---|
| 334,844 | 1/1886 | Briesen | 63/1 R |
| 675,118 | 5/1901 | Sweet | 224/245 |
| 1,453,880 | 5/1923 | Ludwig | 224/196 |
| 1,486,178 | 3/1924 | Antelmi | 63/1 R |
| 2,708,537 | 5/1955 | Dec | 224/196 |
| 2,788,613 | 4/1957 | Gelfand et al. | 46/201 X |
| 2,803,921 | 8/1957 | Garcia-Galiano | 46/202 |
| 3,616,571 | 11/1971 | Adickes | 46/202 |
| 3,686,894 | 8/1972 | Handler | 46/116 X |
| 3,757,459 | 9/1973 | Buck et al. | 46/202 |
| 3,777,391 | 11/1973 | Barcus et al. | 46/1 K |
| 4,016,674 | 4/1977 | Resnick et al. | 46/202 |
| 4,150,508 | 4/1979 | Ogawa | 46/202 |

FOREIGN PATENT DOCUMENTS

| | | | |
|---|---|---|---|
| 985078 | 3/1965 | United Kingdom | 63/1 |

*Primary Examiner*—F. Barry Shay

*Attorney, Agent, or Firm*—Kinney & Lange

[57] ABSTRACT

Housing apparatus for a spring wound toy that includes a wrist band supported housing having a platform for supporting a spring wound toy, for example, a toy racing car, a cover hingedly mounted on the platform and resiliently urged to an open position, and a retractable ramp mounted on the housing. The lock member is a manually operated lock member, resiliently retained in a position to retain the cover in a closed position and upon being moved first releases the cover to permit it to move to an open position and then operates a toy release device to allow the toy to move off the platform. A cover slot, that in a cover closed position opens to the platform, is provided to have the toy winding stem extended therethrough and additionally to aid in restraining motion of the toy within the closure provided by the cover and platform.

6 Claims, 5 Drawing Figures

FIG. 1
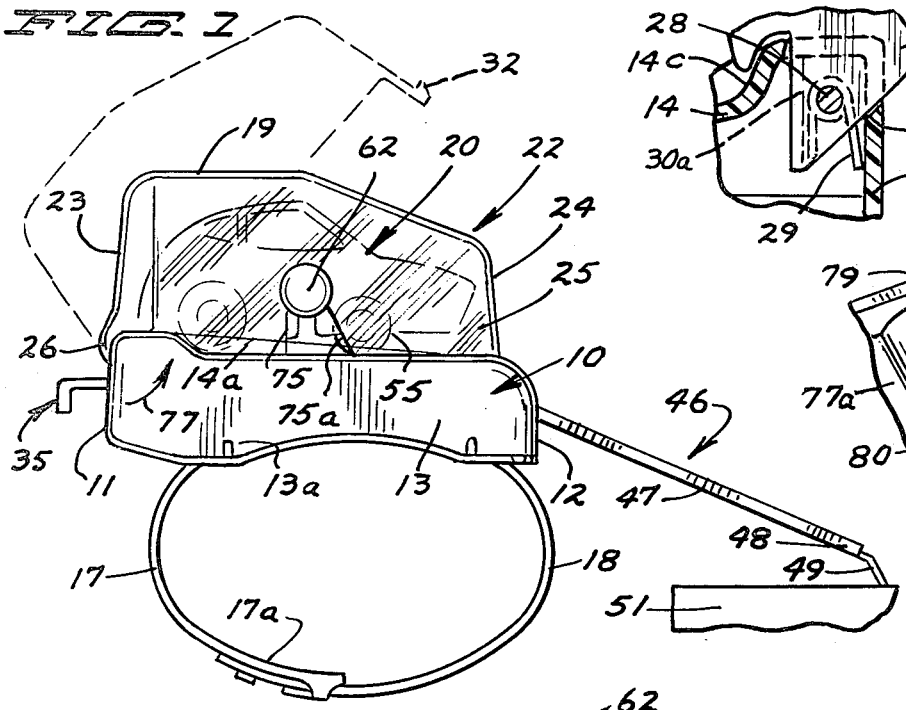
FIG. 4
FIG. 5
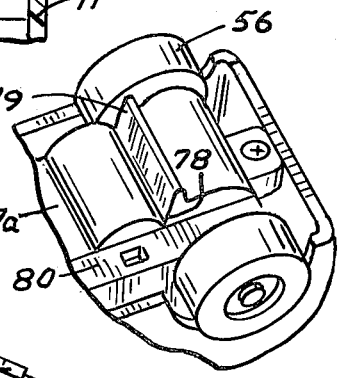
FIG. 2
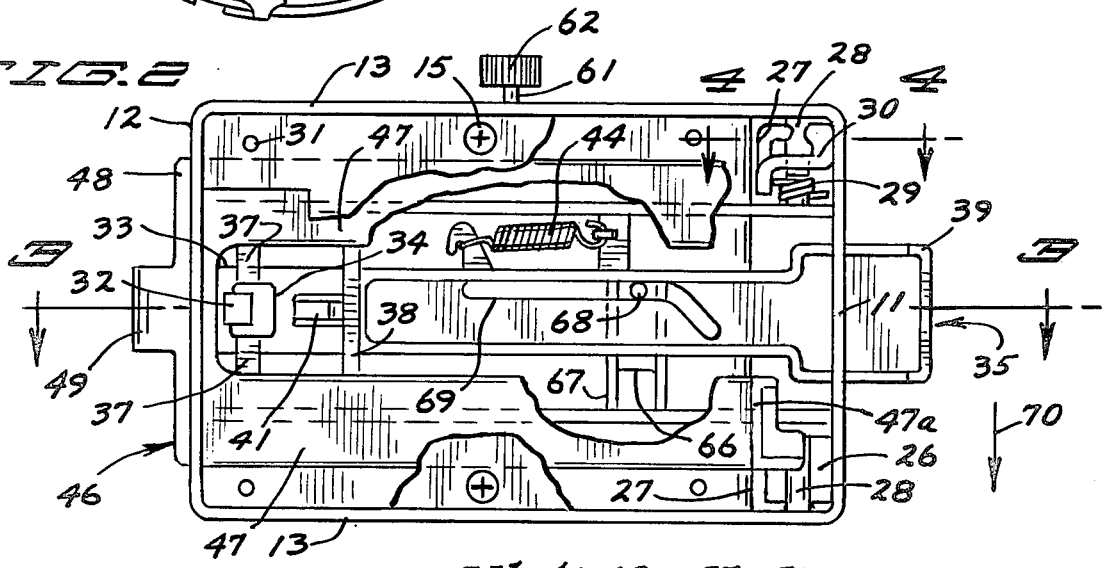
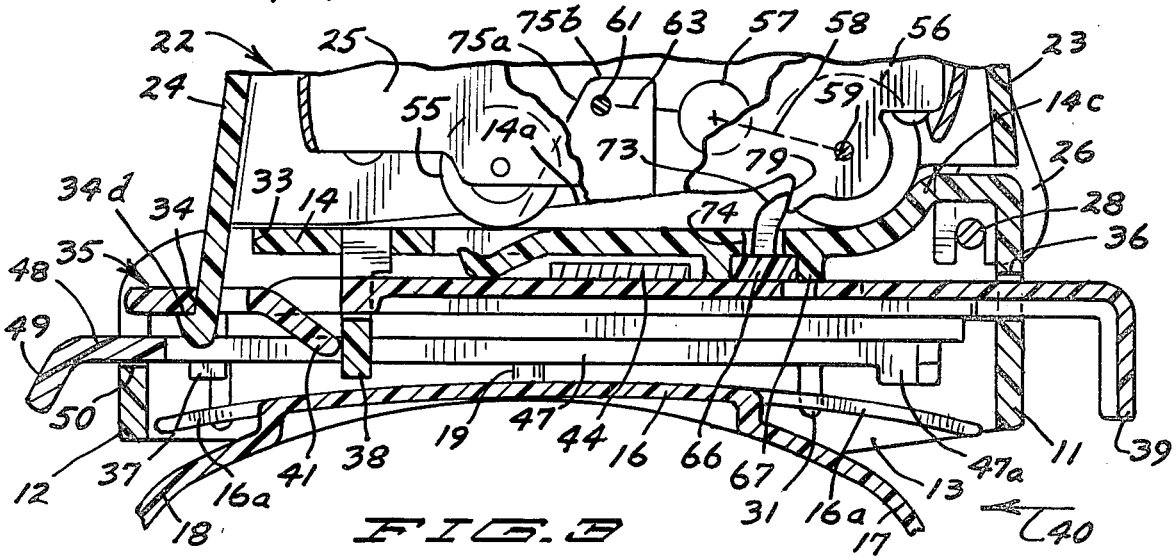
FIG. 3

HOUSING FOR SPRING WOUND TOY

BACKGROUND OF THE INVENTION

This invention relates to a holder for toys.

In U.S. Pat. No. 1,486,178 there is disclosed a wrist watch type band with a base member and a cover threaded on the base member for bathers carrying coins and jewelry. U.S. Pat. No. 3,686,894 discloses a locket for carrying a figure toy such as a doll or doll head, the locket having a pivotally mounted transparent cover and a clip so that it may be clipped to a belt. The patent also discloses the possibility of linking a number of these together to form a belt, necklace or the like. In U.S. Pat. No. 3,616,571 there is disclosed a hanger which can be slipped over a belt for releasably carrying a toy car.

The present invention is concerned with a new and novel combined housing and launching platform for selfpropelled devices, for example toy racing cars.

SUMMARY OF THE INVENTION

The present invention is concerned with a housing for self-propelled devices, for example, toy cars, that includes a self-propelled device supporting platform mounted on a wrist band, a pop-up cover mounted on the platform to form a closure for containing the self-propelled device, and lock mechanism for releasably retaining the cover in a closed position. Desirably a wall of the cover in a closed position has a slot for the winding stem of the device to extend through, the slot also restraining movement of the device in the closure.

One of the objects of this invention is to provide a new and novel housing for carrying a self-propellable device. In furtherance of the above object, it is another object of this invention to provide a new and novel pop-open cover that is releasably locked in a closed position on a self-propelled device supporting platform. Another object of this invention is to provide a wrist type holder having a new and novel cover and mounting thereof which, in conjunction with a toy support member, provides an enclosure for a windable toy and permits winding the toy while it is in the enclosure. Still another object of this invention is to provide a new and novel wrist type holder for a windable vehicle that has a retractable ramp.

BRIEF DESCRIPTION OF THE DRAWINGS

FIG. 1 is a side view of the apparatus of this invention with the ramp shown in an extended position, the cover in a closed position in solid lines, and the cover in an open position in dotted lines;

FIG. 2 is a bottom view of the apparatus of FIG. 1 with the ramp shown in a retracted position with parts of the ramp being broken away, and most of the wrist band being broken away, the view being rotated 180° with respect to the showing in FIG. 1;

FIG. 3 is a fragmentary cross sectional view generally taken along the line and in the direction of the arrows 3—3 of FIG. 2 with portions of a toy car being diagrammatically shown;

FIG. 4 is a fragmentary cross sectional view generally taken along the line and in the direction of the arrows 4—4 of FIG. 2 to show the mounting of the spring that resiliently urges the cover to an open position; and FIG. 5 is a fragmentary perspective view of the car chassis to show the bottom portion thereof that is engageable by the release device to prevent the car moving off the platform until the lock member has been moved to its vehicle release position.

Referring now to the drawings, the apparatus of this invention includes a lower housing, generally designated 10, having a rear end wall 11, a front end wall 12, side walls 13, and a top wall (platform) 14 joined integrally together in the illustrated embodiment, the lower housing opening downwardly in a position of use on a wrist. Ribs **13*c* project outwardly from side walls 13. The general outline of the top wall 14 is shown in FIG. 2. The housing 10 is designed to have the supported toy (vehicle) 20 self-propelled off the platform 14. A base member 16 of a configuration generally conforming to that bounded by the walls 11, 12 and 13 is removably secured to the lower housing 10, for example, in part by screws 15 threaded into housing bosses 19, to close at least a major portion of the lower housing bottom opening. The base member 16 forms part of a wrist band which includes a strap 17 having one end joined to one end portion of the base member and a strap 18 having one end joined to the opposite end portion of the base member. The base member has tab portions 16*a* (FIG. 3) on each transverse side of the strap that extend longitudinally between juncture of the straps to the base member and the adjacent housing side wall. Housing studs 31 have reduced diameter end portions extended through apertures in tabs 16*a* and the base member has studs 13*d* removably extended into housing side wall apertures 13*a* . The straps 17 and 18 are provided with a conventional adjustable fastening means 17*a*** for removably fastening the straps together on wrists of different sizes. Advantageously, the wrist band is made of semirigid deformable plastic material.

To retain the vehicle on the platform while the wrist band is being worn there is provided a transparent cover, generally designated 22, and forming the upper part of the housing. The cover has longitudinally spaced end walls 23 and 24, side walls 25 and a top wall 19 joined to form a downwardly opening closure that opens to the platform when the cover is in a closed condition. Ear portions 26 and 30 are joined to the lower part of cover end wall 23 and extend through openings 27 in the platform and housing wall 11 and into the housing and are pivotally secured to the lower housing by transverse housing pivot pins 28. A torsion spring 29 is provided on one of the pivot members and has one end portion abutting against end wall 11 and an opposite end portion abutting against a flange **30*a* of ear portion 30 to constantly resiliently urge the cover to an open position (dotted line position of FIG. 1). The pivotal movement of the cover in the direction of arrow 77 about pivots 28 is limited by the lower edge of the cover wall 23 that is between ears 26,30 abutting against housing wall 11**.

For releasably retaining the cover in a closed position, a hooked portion 32 is integrally joined to end wall 24 to extend downwardly through the housing notch 33 that opens through the platform and end wall 12. The hooked portion is extendable through an opening 34 in a longitudinally elongated lock member, generally designated 35, to latchingly engage the lock member when it is in its lower position to retain the cover in its closed position.

The lock member 35 is longitudinally and slidably reciprocal through a slot 36 in end wall 11 and in part is supported by housing slide supports 37 and 38, both of which are secured to the housing 10. The movment of the lock member in a release direction (arrow 40 in the lower right hand corner of FIG. 3) is limited by the depending lock member flange 39 at one end thereof abutting against end wall 11 while the movement in the opposite direction is limited by a lock member tab 41 abutting against the web of slide support 38. A coil spring 44 is connected between a lock member hooked portion 54 secured to lock member 35 and a housing lug 60 secured to the housing to constantly resiliently urge the lock member 35 to its initial position in which tab 41 abuts against slide support 38 and flange 39 is spaced from wall 11.

A ramp, generally designated 46, is slidably extended through a slot 50 in end wall 12 that opens to notch 33. The ramp has a central U-shaped opening bounded by legs 47 over which the vehicle moves. The legs 47 have downwardly extending ribs **47*a* at the near extremity thereof, which ribs abut against front end wall 12 to limit the movement of the ramp in the direction of arrow 40 to its extended position. The outer edges of the ramp are designated by numerals 52 and 53. The slot 50 is of a height to permit the ramp pivoting from a horizontal position to an inclined extended position such as shown in FIG. 1. The base 48 of the U-shaped slot abuts against slide support 37 to limit the movement of the ramp in a direction opposite arrow 40 to a retracted position shown in FIG. 3 in which only part of the ramp base 48 and tab 49 are located outside of the housing. The tab 49 is joined to the web and in a ramp extended position is abuttable against a surface of a floor or table top 51**.

The vehicle 20, for example, a toy racing car, as best shown in FIG. 3, has front and rear wheels 55 and 56 respectively, a spring motor 57 drivingly connected through a conventional drive connection represented by dotted line 58 to the rear axle 59 to drive the rear wheels, and a winding stem 61 having a winding knob 62 on one end thereof for directly winding the spring motor, or connected through a conventional gearing arrangement represented by dotted line 63 in FIG. 3 to wind the motor.

To releasably retain the vehicle in a stop position when the motor is wound and the cover is open there is provided cooperating means on the vehicle and the housing which includes a slide 66 mounted between the platform, the lock member and transverse housing flanges 67 (FIG. 2) for limited transverse movement. A depending slide pin 68 on slide 66 extends into a lock member slot 69 so that, as the longitudinal portions of the walls defining the slot move pass the pin, the slide remains stationary. However, when the transversely and longitudinally inclined portions of the slot walls are moved in the direction of arrow 40 in engagement with the pin, the slide is transversely moved in the direction of arrow 70 (right hand side of FIG. 2) from its vehicle retaining stop position to its vehicle release position.

The slide has a stop 73 (FIG. 3) extending upwardly through a platform opening 74 in the rearwardly horizontal part of the platform. When pin 68 is in the longitudinal part of slot 69, stop 73 extends up into a transverse recess 78 of the vehicle chassis **77*a* when the vehicle is properly positioned on the platform, the recess in part being defined by a depending rear transverse flange 79. On one transverse side of the recess the chassis has a lower longitudinal surface 80 (FIG. 5) that is at a higher elevation than the lower part of flange 79, no part of the chassis directly rearwardly of surface 80 extending to a lower elevation than surface 80 when the car is upright. As the slide pin 68 is moved through the inclined portion of slot 69, stop 73 is moved transversely through recess 78 to be completely beneath surface 80**. At this time the vehicle is self-propelled to move forwardly off the platform without interference from the stop if the cover is in an open position and the spring motor is wound.

As may be noted in FIG. 3, in the carry position the vehicle rear wheels are located substantially between stop 73 and the upwardly and rearwardly arcuately curved portion **14*c* of the platform. Further, the wheels are located transversely between upwardly projecting, longitudinal ribs 14*a*** of the platforms and the cover side walls in a closed position abut against the platform on opposite transverse sides of the ribs.

In order that the spring motor may be wound when the vehicle is in the enclosure formed by the platform and the cover is in a closed position, one of the cover side walls is provided with a slot 75 that opens downwardly to the platform. The winding stem 61 extends through slot 75 with the knob 62 being located outside the enclosure. At this time the winding stem extends through slot 75 closely adjacent the slot corner defined by the slot top edge **75*b* and the forwardly and downwardly inclined slot edge 75*a*. Due to the inclination of edge 75*a* the cover can pivot in the direction of arrow 77 (FIG. 1) about housing pivots 28 to its open position without interference from the stem. At the same time slot edges 75*a* and 75*b*, when the cover is in closed position, aid in the restraining movement of the vehicle, even when the housing is upside down or in other positions, i.e. they retain the vehicle relative to the platform in a position closely adjacent that shown in FIGS. 1 and 3**.

Either when the wrist band is on or off the wrist of the user the lock member can be pushed in the direction of the arrow 40 sufficiently to release the latching engagement with the lock member and thence the cover will pop up to its open position due to the action of spring 29. The vechicle now can be placed on the platform and then the cover can be manually moved to its closed position. Due to the taper of the lower front surface of the hooked portion 32, as it moves into opening 34 of the lock member in its initial position, the lock member is cammed in the direction of the arrow 40; and upon the hooked portion surface 34 moving below the opening, the lock member is resiliently returned to its initial position to lock the cover in its closed position.

When it is desired to "race" the vehicle, the spring motor is wound and the wrist positioned on or adjacent a surface as the floor or table top and the ramp moved to its extended position. Now upon initially pushing flange 39 in the direction of arrow 40 the lock member 35 is pushed to a position such that the cover pops up. Since the slot 75 is open at the bottom, the cover can move up freely. Then upon further movement of the lock member 35 in the same direction, the inclined slot portion 69 of the lock member engages the slide pin 68 and moves the slide transversely whereby stop 73 is moved out of abutting engagement with the chassis flange 79. As soon as the flange is moved out of engagement with flange 79, the vehicle moves forwardly over the top horizontal surface portion of the platform, thence over the downwardly and forwardly arcuately curved surface of the platform onto the ramp legs, then off the ramp onto the table or floor under the power provided by the spring motor.

Even though the invention has been described with reference to a toy racer, it is to be understood the toy could be, for example, a walking doll having a spring motor to impart motion to the legs, or a spring wound helicopter. The size and shape of the cover and the cover slot 75 would depend on the toy to be used with the holder of this invention. In the event it is to be used with a helicopter, the cover hinge portion would be modified so that the cover could pivot further in the direction of arrow 77 from that shown in dotted lines in FIG. 1 and there would be no need to provide the retractable ramp.

What is claimed is:

1. A wrist worn housing for a spring wound toy vehicle having a winding stem, comprising:

a wrist band;

platform means mounted on the wrist band for supporting a spring wound toy vehicle;

a cover mounted on the platform means to form an enclosure for the toy in conjunction with the platform means, said cover having a recess for the winding stem to extend beyond the cover when the toy is on the platform means in said cover to allow winding of the vehicle and said cover being so disposed on said platform means as to allow said vehicle to leave said enclosure;

said housing having a releasable latch secured thereto for retaining said vehicle on said platform and means for releasing said vehicle from said latch; and a ramp supported on said housing and movable between retracted and extended positions;

said ramp when in retracted position being closely adjacent the cover and not extending substantially beyond it, and said ramp being capable when moved to said extended position to act as a ramp for the vehicle to move onto when the vehicle is released.

2. The apparatus of claim 1 further characterized in that the cover is hingedly mounted on the platform means and in which the opening for the winding stem is a slot through which the winding stem extends when the toy vehicle is on the platform means, said slot opening to the platform means when the cover is in its closed position.

3. The apparatus of claim 1 further characterized in that the platform means comprises an enclosure, the upper wall of which constitutes a toy supporting platfrom and that said ramp is slidably supported in said enclosure and movable into and out of said enclosure between retracted and extended positions;

said enclosure being sufficiently long with respect to the length of said ramp that when said ramp is in said retracted position, the major portion is located in the enclosure, and said ramp being capable when moved out of the enclosure to said extended position to act as a ramp for the vehicle to move onto when the vehicle is released.

4. The apparatus of claim 1 further characterized in that the cover is made of transparent plastic.

5. A wrist worn housing for a spring wound vehicle having a winding stem, comprising:

a wrist band;

platform means for supporting a spring wound vehicle, said platform means comprising an elongated enclosure;

a cover for cooperating with the platform means to form an enclosure for the vehicle;

said cover being movable relative to the platform means between an open position and a closed position and having a wall that has a slot for the winding stem to extend through, the slot opening to the platform means in the cover closed position and not interfering with the vehicle leaving the platform means when the cover is open;

means on the platform means for moving the cover to its open position;

means on the platform means for releasably retaining the cover in its closed position, and a slidable ramp, supported in said elongated enclosure and movable into and out of said elongated enclosure between retracted and extended positions;

said elongated enclosure being sufficiently long with respect to the length of said ramp that when said ramp is in said retracted position, the major portion is located in the elongated enclosure, and said ramp being capable when moved out of the elongated enclosure to said extended position to act as a ramp for the spring wound vehicle to move onto when the vehicle leaves the platform means.

6. The apparatus of claim 5 further characterized in that the means for moving the cover to its open position comprises a spring acting between the cover and platform means.

* * * * *